US011785684B2

(12) United States Patent
James et al.

(10) Patent No.: US 11,785,684 B2
(45) Date of Patent: Oct. 10, 2023

(54) LIGHT APPARATUS WITH PARALLEL-ARRANGED LEDS AND PER-LED DRIVERS

(71) Applicant: Textron Systems Corporation, Hunt Valley, MD (US)

(72) Inventors: Timothy Michael James, Romsey (GB); Andrew John Seager, Havant (GB)

(73) Assignee: Textron Systems Corporation, Hunt Valley, MD (US)

( * ) Notice: Subject to any disclaimer, the term of this patent is extended or adjusted under 35 U.S.C. 154(b) by 41 days.

(21) Appl. No.: 17/543,011

(22) Filed: Dec. 6, 2021

(65) Prior Publication Data

US 2022/0201814 A1 Jun. 23, 2022

(30) Foreign Application Priority Data

Dec. 22, 2020 (EP) ..... 20216476

(51) Int. Cl.
*H05B 45/10* (2020.01)
*H05B 45/30* (2020.01)

(52) U.S. Cl.
CPC ..... *H05B 45/10* (2020.01); *H05B 45/30* (2020.01)

(58) Field of Classification Search
CPC .. H05B 45/3725; H05B 45/10; H05B 45/397; H05B 45/44; H05B 45/20; H05B 45/46; H05B 45/12; H05B 45/18; H05B 45/385; H05B 47/155; H05B 45/325; H05B 45/48; H05B 47/165; H05B 47/18; H05B 47/28; H05B 45/37; H05B 45/22; H05B 45/54;

(Continued)

(56) References Cited

U.S. PATENT DOCUMENTS 6,933,707 B2 8/2005 Allen
7,015,654 B1 * 3/2006 Kuhlmann ..... H02M 3/156 315/291

(Continued)

FOREIGN PATENT DOCUMENTS

CN 105657899 B 12/2017
EP 3713377 A1 9/2020
GB 2517455 A 2/2015

OTHER PUBLICATIONS

Chung et al.; "Paralleled LED Strings: An Overview of Current-Balancing Techniques," IEEE Industrial Electronics Magazine, IEEE, US, vol. 9, No. 2, Jun. 1, 2015, pp. 17-23.

*Primary Examiner* — Monica C King
(74) *Attorney, Agent, or Firm* — BainwoodHuang

(57) ABSTRACT

A light apparatus includes an array of light-emitting diodes (LEDs) in parallel arrangement, in which the LEDs have respective first terminals coupled together for connection to a supply node of a power source that provides the drive current to the LEDs during operation. Driver circuity is disposed between respective second terminals of the LEDs and a return node of the power source. The driver circuitry includes a respective LED driver for each of the LEDs, and each LED driver includes (1) a transistor connected to the second terminal of the respective LED, and (2) a resistor in series between the transistor and a return node of the power source, the transistors of the LED drivers having respective control inputs for receiving respective LED drive signals to control operation of the LEDs.

11 Claims, 2 Drawing Sheets

(58) Field of Classification Search
CPC .... H05B 45/375; H05B 45/395; H05B 45/52; H05B 45/56; H05B 44/00; H05B 47/11; H05B 47/16; H05B 47/19; H05B 45/30; H05B 45/31; H05B 45/382; H05B 45/39; H05B 47/10; H05B 47/105; H05B 47/175; H05B 31/50; H05B 45/3577; H05B 45/38; F21K 9/232; F21K 9/238; F21K 9/235; F21K 9/65; F21K 9/68; F21K 9/69; F21S 9/03; G09F 9/33; G02F 1/133603; G02F 1/133612; F21Y 2115/10; F21Y 2105/18; Y02B 20/30; Y02B 10/10; Y02B 20/40; F21V 23/005; F21V 23/006; F21V 23/009; F21V 29/713; F21V 29/74; F21V 29/773; F21V 29/83; F21V 5/007; F21V 7/0016; F21V 7/0091
See application file for complete search history.

(56) References Cited

U.S. PATENT DOCUMENTS

| | | | | |
|---|---|---|---|---|
| 7,375,476 | B2 | 5/2008 | Walter et al. | |
| 8,179,059 | B2 | 5/2012 | Yang et al. | |
| 8,476,837 | B2 | 7/2013 | Vos | |
| 8,531,118 | B2 | 9/2013 | Miskin et al. | |
| 8,665,922 | B2 | 3/2014 | Fujimura et al. | |
| 8,736,099 | B2 | 5/2014 | Langlois et al. | |
| 8,907,591 | B2 | 12/2014 | Jungwirth | |
| 9,461,027 | B2 | 10/2016 | Schug | |
| 9,516,718 | B2 | 12/2016 | Jung et al. | |
| 10,165,637 | B2 | 12/2018 | Yoo et al. | |
| 2007/0069633 | A1 | 3/2007 | Kameyama et al. | |
| 2007/0296354 | A1 | 12/2007 | Okabe | |
| 2008/0054815 | A1 | 3/2008 | Kotikalapoodi et al. | |
| 2011/0069094 | A1* | 3/2011 | Knapp | G09G 3/3426 345/82 |
| 2011/0080112 | A1* | 4/2011 | Shearer | H05B 45/10 323/273 |
| 2012/0223648 | A1 | 9/2012 | Jin et al. | |
| 2013/0082615 | A1* | 4/2013 | Williams | H05B 45/52 315/186 |
| 2013/0147372 | A1* | 6/2013 | Williams | H05B 45/3725 315/185 R |
| 2013/0147375 | A1* | 6/2013 | Williams | H05B 45/20 315/192 |
| 2013/0207559 | A1 | 8/2013 | Ferrier | |
| 2014/0300274 | A1 | 10/2014 | Acatrinei | |
| 2022/0198995 | A1* | 6/2022 | Ahmed | H01L 27/1255 |

* cited by examiner

LIGHT APPARATUS WITH PARALLEL-ARRANGED LEDS AND PER-LED DRIVERS

BACKGROUND

The invention is related to the field of light-emitting diode (LED) lighting.

With LED-based lighting, it is common to employ an array of single LEDs to obtain a desired light output. In an area-lighting application, for example, a large array (e.g., tens or hundreds) of LEDs may employed. In a typical configuration, the LEDs are arranged in series, and a single field-effect transistor (FET) switch is used to control current conduction. The FET can be driven completely on and completely off, resulting in corresponding full-on and full-off states of the LED array. In some applications the FET may be driven in a pulsed manner in order to obtain a dimming effect. Additionally, variable LED output is possible through proportional control.

SUMMARY

There can be drawbacks to realizing large LED arrays using series arrangements as described above. A typical LED used for lighting may have a forward voltage on the order of 5 volts, which means that a string of 100 such LEDs requires a power supply voltage on the order of 500 volts. Such high-voltage power supplies are very specialized and preferably avoided in many applications.

A light apparatus is disclosed that includes an array of light-emitting diodes (LEDs) in parallel arrangement, in which the LEDs have respective first terminals coupled together for connection to a supply node of a power source that provides the drive current to the LEDs during operation. Driver circuity is disposed between respective second terminals of the LEDs and a return node of the power source. The driver circuitry includes a respective LED driver for each of the LEDs, and each LED driver includes (1) a transistor connected to the second terminal of the respective LED, and (2) a resistor in series between the transistor and a return node of the power source, the transistors of the LED drivers having respective control inputs for receiving respective LED drive signals to control operation of the LEDs.

By use of the parallel arrangement for the LED array, the light apparatus can employ a relatively low-voltage power supply having an output on the order of 10 volts, for example, which can be a significant advantage in many applications. The driver circuitry have per-LED drivers can provide for uniform light intensity among the LEDs, which is also advantageous in applications such as display lighting for example.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Overview

Disclosed is an electronic drive circuit design that improves the output performance of an array of LEDs, through more consistent electrical control of each LED in the array.

Existing methods of control use a single FET device to control the entire array of LEDs. This design requires a single larger power FET and results in a variation in current drive over each LED. Each LED is placed in series with a resistor and the larger the value of this resistor the less the variation in current flow in the LEDs due to variation in the forward voltage. However consequence of this is a large wasted power dissipation in the series resistor and increased supply voltage. Both requiring more expensive and larger power supply to supply the array voltage. Additionally, the variation in current across the array generally results in over and under-driving of LEDs in the array for any set power level. This prevents the LED array operating at maximum power rating without some LEDs being overdriving or some underdriven.

An advantage of driving LEDs in a parallel array as opposed to a series array is that a lower supply voltage, only slightly higher than the typical forward voltage can be used, rather than in the series case a voltage in excess of the summed forward voltages is required.

The disclosed circuit design reduces the variation in drive current to each LED, enabling the circuit to have more even control of the LED array. This allows the circuit to drive all the LEDs at their maximum power limit, without over or under driving, and provide a greater power output within the limits of each LED. This can improve the life of the LEDs for the same output power. The output power is more consistent over the range of input signals due to more uniform light output across the LEDs.

Description of Embodiments

Figure 1:
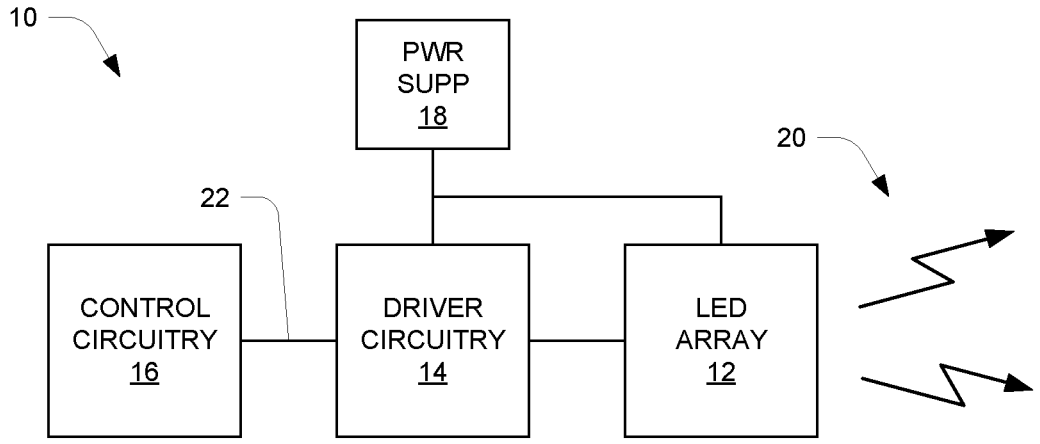
FIG. 1 is a block diagram of a light apparatus.

FIG. 1 shows light apparatus 10 including a light-emitting diode (LED) array 12, driver circuitry 14 and control circuitry 16. Also shown is a power supply (PWR SUPP) 18 that provides electrical power to the LED array 12 partly via the drive circuitry 14. In operation, the LED array 12 produces light 20 as required for an application of the light apparatus 10, such as area lighting, signal lighting, display lighting, etc. The driver circuitry 14 generally includes an array of switching power devices such as power field-effect transistors (FETs) that provide for controlled switching of current through the LEDs of the LED array 12. The control circuitry 16 performs higher-level control functions, and uses control signals 22 to control operation of the driver circuitry 14. Additional details and examples of these functions and operations are described more below.

Figure 2:
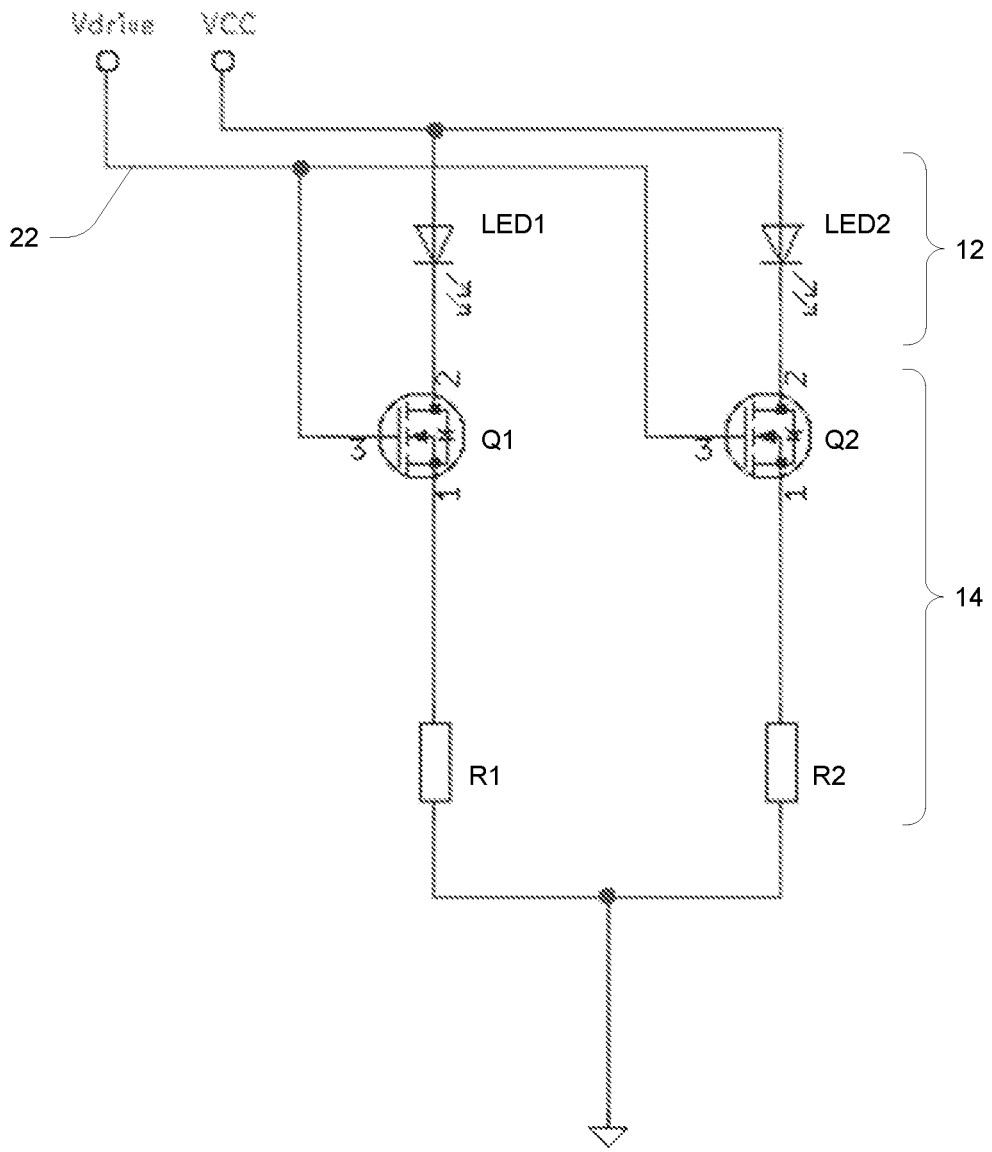
FIG. 2 is a schematic diagram of simplified LED lighting circuit showing parallel arrangement and per-LED drivers.

FIG. 2 shows an example realization of the LED array 12 and driver circuitry 14. This simplified example shows the use of two LEDs, LED1 and LED2, and corresponding LED drivers Q1/R1 and Q2/R2. Thus each LED is connected (at its anode) to the positive power rail VCC and connected (at its cathode) to the drain terminal of the corresponding FET. The inputs from the power supply 18 are shown as VCC and ground (triangle symbol at bottom), and the control input 22 is shown as a signal Vdrive. It will be appreciated that this is a parallel arrangement of the LEDs LED1 and LED2, i.e., corresponding terminals are connected together (in this case the anodes) such that there are independent current paths through them. This is in contrast to a serial arrangement in which the conduction channels (e.g., source/drain channels for FETs) are connected in series such that the same current flows through both devices. Although this simplified example shows only two parallel-arranged LEDs, in a practical application there may be many more (e.g., tens or hundreds) of parallel-arranged LEDs, each with a corresponding transistor-resistor driver. Also in this example, a single control signal Vdrive is provided, such that the entire array of LEDs operates as one unit accordingly, such as being switched fully on or fully off for example. In alternative embodiments, different subsets of the LEDs may receive different control signals 22, enabling independent control of the subsets and different types of operation.

The embodiment of FIG. 2 uses a FET transistor Qx (x=1, 2) along with a current-limiting resistor Rx to control each LED LEDx individually. In this example, the control signal Vdrive is supplied to the gate of each FET Qx. One significant benefit of the parallel arrangement of FIG. 2 is the ability to use a relatively small supply voltage VCC even if the LEDs have relatively high forward (conduction) voltages. For example, currently available LEDs may have a forward voltage of approximately 5 volts, and in such a case a VCC of about 10 volts may be used, even if there are hundreds of LEDs in the array 12. This can be contrasted with a serial arrangement, in which a serial-connected array of 100 such LEDs would require a VCC on the order of 500 volts. More generally, the parallel arrangement enables use of a power supply voltage on the order of the forward voltage of a single LED, i.e., of the same order of magnitude, rather than requiring a supply voltage being a large multiple of LED forward voltage as is required when a series arrangement is used.

Generally, the placement of the current-limiting resistor Rx between the FET source terminal and ground, as illustrated in FIG. 2, allows for a greater control resolution of the current flowing through the corresponding LED, more so than a standard LED driver IC which typically has a coarser resolution. The resolution is only limited by the resolution of the control signal driving the FET (e.g., Vdrive). This placement of the current-limiting resistor also helps equalize the currents in the different LEDs, as the resistor "sees" the relatively uniform input gate voltage of the FET in respect to ground rather than the voltage applied to the LED, which is subject to variations in LED forward voltage. This results in a current variation that is mainly subject to resistor tolerance, along with small variance in FET turn on voltage. To minimize this variation a FET with a narrow spread of turn on voltage variation over quantity and temperature may be used. Thus the variation in the current flow in each LED is much less than when determined by the variation in forward voltage of each LED.

Figure 3:
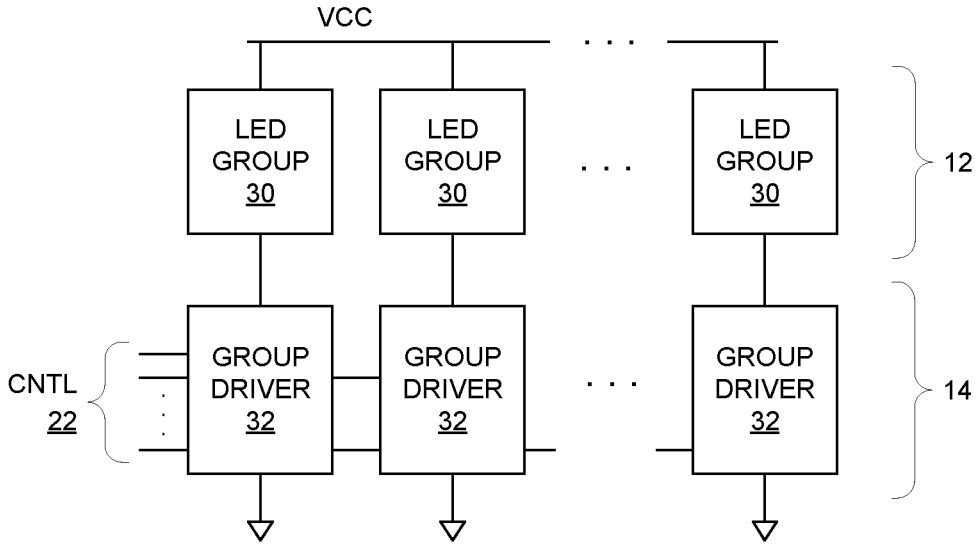
FIG. 3 is a block diagram of a generalized version of the structure of FIG. 2.

FIG. 3 illustrates a generalization of the structure of FIG. 2 that is encompassed by the general organization of FIG. 1. In this case the LED array 12 comprises a collection of LED groups 30, and the driver circuitry 14 comprises corresponding group drivers 32 as shown. It will be appreciated that the arrangement of FIG. 2 may be seen as an example in which each LED group 30 is realized by a single LED LEDx, and each group driver 32 by a corresponding FET Qx and resistor Rx. FIG. 3 allows for the possibility of using a more complex arrangement in place of individual LEDs, such as for example a short string of serial-connected LEDs, in each of the LED groups 30. The group drivers 32 may also be realized in slightly different ways, for example by using parallel-connected FETS in place of a single FET for greater current handling. As illustrated, the control signals 22 are provided to the group drivers 32 to control the conduction of their switching/regulating transistors, thereby control conduction of the LEDs of the LED groups 30.

Applications and Other Features

Generally, the disclosed light apparatus 10 may be used in any of a variety of applications using an LED array for generating light, particularly in applications requiring consistent brightness among LEDs. These include lighting applications such as stage lighting, traffic lights, and information display, for example. Other applications include the use of LED arrays for emission of IR, UV or other wavelengths of light for power transmission or irradiation. LED arrays may be a matrix design, linear layout or other layout combinations. The circuit design is effective for the control of multiple LEDs at the same time More broadly, the apparatus may find utilization in the following general areas:

- Lighting industries
- Display technologies
- Sterilization equipment
- Power transmission
- Sensor and control technologies Advantages and features of the disclosed light apparatus may include some or all of the following:

- Use of individual FET per LED in a LED parallel connected array
- Ability to mix LEDs that have variation in forward voltage in an LED parallel connected array and still maintain a uniform current distribution
- Ability to operate from a low voltage power source that is only slightly higher than the forward voltage of the LEDs by the voltage drop over the current limit resistors
- Driving individual FETs either in parallel for a uniform array emission distribution or by a variable or fixed binary state to produce a pattern distribution of illumination from the array.
- Alternative in which FETs are not used to switch LEDs on and off, but rather just keep the LEDs on at the some predefined controllable intensity While various embodiments of the invention have been particularly shown and described, it will be understood by those skilled in the art that various changes in form and details may be made therein without departing from the scope of the invention as defined by the appended claims.

What is claimed is:

1. Light apparatus, comprising:

an array of light-emitting diodes (LEDs) in parallel arrangement, the LEDs having respective first terminals coupled together for connection to a supply node of a power source providing drive current to the LEDs during operation of the light circuit; and driver circuity disposed between respective second terminals of the LEDs and a return node of the power source, the driver circuitry including a respective LED driver for each of the LEDs, each LED driver including (1) a transistor connected to the second terminal of the respective LED, and (2) a resistor in series between the transistor and a return node of the power source, the transistors of the LED drivers having respective control inputs for receiving respective LED drive signals to control operation of the LEDs.

2. The light apparatus of claim 1, wherein the LED drivers are sized in relation to a supply voltage of the power source to drive the LEDs at substantially a maximum rated power output.

3. The light apparatus of claim 1, wherein the power supply has a supply voltage on the order of a forward voltage of the LEDs.

4. The light apparatus of claim 1, wherein each of the LEDs is part of a corresponding LED group being an arrangement of individual LEDS controlled together by the corresponding LED driver.

5. The light apparatus of claim 4, wherein the arrangement of each of the LED groups is a series arrangement of a plurality of LEDs of the LED group.

6. The light apparatus of claim 4, wherein the transistor of each of the LED drivers is a respective first transistor, and each of the LED drivers further includes a respective second transistor in parallel with the first transistor to provide corresponding current switching ability for the corresponding LED group.

7. The light apparatus of claim 1, included in one of stage lighting, traffic signal, or information display.

8. The light apparatus of claim 1, wherein the LEDs generate light output in one of infrared or ultraviolet wavelengths.

9. The light apparatus of claim 1, having a uniform light output across the LEDs of the LED array notwithstanding variation in forward voltage of the LEDs, by operation of the LED driver circuitry.

10. The light apparatus of claim 1, configured for one of (1) driving individual transistors in parallel for a uniform array emission distribution, or (2) driving individual transistors by a variable or fixed binary state to produce a pattern distribution of illumination from the LED array.

11. The light apparatus of claim 1, wherein the control inputs have fixed values that maintain the LEDs at a predefined intensity.

* * * * *